United States Patent [19]

Ahern

[11] Patent Number: 5,007,139

[45] Date of Patent: Apr. 16, 1991

[54] NECKTIE RETAINER

[76] Inventor: Mark E. Ahern, 1278 Southwest Highpoint La., Palm City, Fla. 34990

[21] Appl. No.: 550,204

[22] Filed: Jul. 10, 1990

Related U.S. Application Data

[63] Continuation-in-part of Ser. No. 404,180, Sep. 7, 1989, abandoned.

[51] Int. Cl.[5] ..... A41D 25/10

[52] U.S. Cl. ..... 24/49 R; 24/49 CF; 24/49 TS

[58] Field of Search ..... 24/49 R, 49 CF, 49 M, 24/49 CC, 49 CP, 49 A, 49 P, 49 TS, 49 C, 50–56, 58, 60, 65

[56] References Cited

U.S. PATENT DOCUMENTS

| | | | |
|---|---|---|---|
| 1,291,090 | 1/1919 | Nuzum . | |
| 1,991,797 | 2/1935 | Drinkwater | 24/49 CF |
| 2,006,427 | 7/1935 | Wolfson . | |
| 2,013,061 | 9/1935 | Loewinsohn | 24/49 TS |
| 2,065,831 | 12/1936 | Smith | 24/49 CF |
| 3,494,003 | 2/1970 | Bower, Jr. | 24/49 |
| 3,529,327 | 9/1970 | Missakian . | |
| 3,802,032 | 4/1974 | Weed | 24/49 CC |
| 3,968,544 | 7/1976 | Sinclair | 24/49 CF |
| 4,184,231 | 1/1980 | Konnan | 24/49 R |
| 4,554,710 | 11/1985 | Grant | 24/49 CF |
| 4,686,716 | 8/1987 | Burns | 2/152 R |

FOREIGN PATENT DOCUMENTS

| | | | |
|---|---|---|---|
| 616351 | 2/1961 | Italy . | |
| 457994 | 12/1936 | United Kingdom | 24/49 TS |

*Primary Examiner*—Laurie K. Cranmer

[57] ABSTRACT

A necktie retainer that restricts movement of the necktie by providing a full flexure tensor member attached to the upper garment of the wearer, a necktie movement governing length of filamentary material with full flexure, distributed direct mechanical attachment to each rear folded portion of the larger end of the necktie. The movement restriction is facilitated through the use of a necktie with a cross member and employing a detachable member on the tensor member that for retention uses the cross member width dimension and for attachment and release uses the cross member thickness dimension. The retainer accommodates different garment and necktie constructions, does not have parts visible from the front and permits relative movement of the central parts of the necktie.

4 Claims, 2 Drawing Sheets

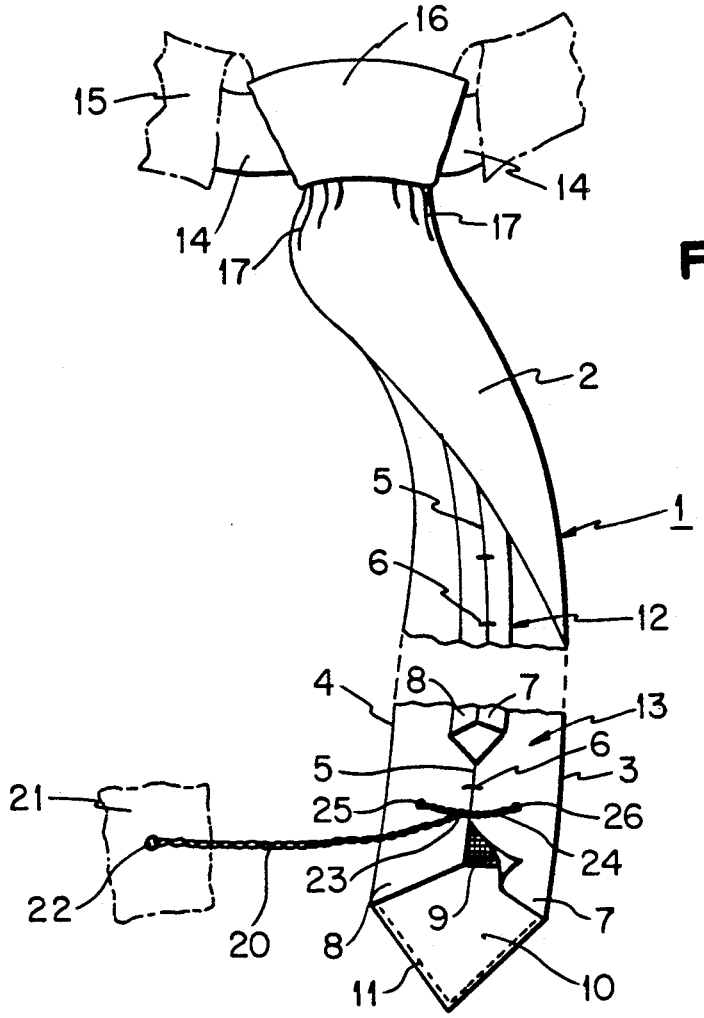
FIG. 1
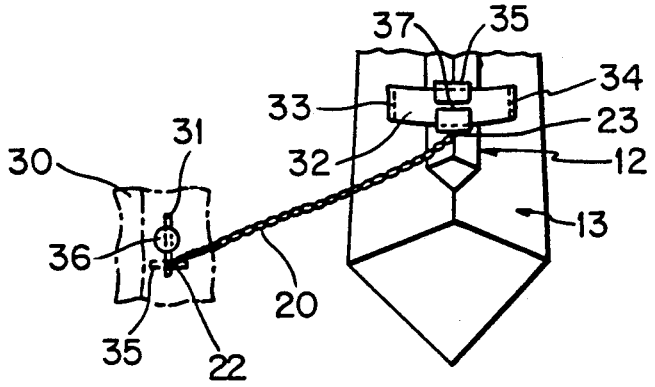
FIG. 2
FIG. 3
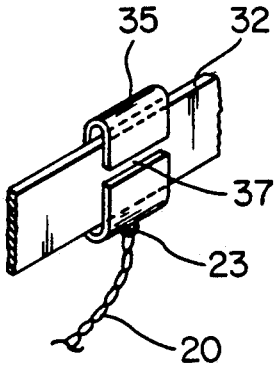

NECKTIE RETAINER

This application is a continuation of application Ser. No. 07/440,180 filed 09/07/89 now abandoned.

FIELD OF THE INVENTION

The invention relates to the retention of a four-in-hand type necktie within a range of movement with respect to the garment of the wearer.

BACKGROUND OF THE INVENTION

The four-in-hand type necktie is an article of wearing apparel that has a generally long and narrow shape with end portions that have different widths. In use it encircles the neck of the wearer, is tied in a knot adjacent to the neck with the end portions lying flat on the garment of the wearer with the larger end portion covering the smaller.

The purpose of the necktie is principally decorative. The shape during wearing and degree of movement during wearing are of importance to the wearer. The tie is constructed so that the knot, the folds of the material of the tie and the ends all assume and maintain a particular shape and position through long hours of wearing yet return to the original position and shape upon removal. Of particular importance is that the end portions lie essentially flat, the larger one over the smaller adjacent the garment of the wearer and not freely swing under conditions of wind and wearer motion, and for safety concerns. It is of importance to some wearers that the retention means not be visible from the front.

The control of the degree of movement of the necktie has been accomplished through the use of devices, such as clips, pins and holders, which retain the portions of the necktie with relation to each other and with relation to the garment of the wearer. In the types of retention employed heretofore, there have been several disadvantages. The device has either gripped the portions of the necktie in such a way as to distort their relative movement or perforated the material of the necktie. A need has arisen for a necktie retention device that does not damage or distort the material of the necktie, permits the portions thereof to move with respect to each other and can accommodate being out of view from the front.

SUMMARY OF THE INVENTION

The invention provides necktie retention by employing a tensor member attached at one end to the garment of the wearer at a full flexure point or fully moveable point and attached through another full flexure point or fully moveable point to the necktie, with the retention stress being distributed over both the folded portions of the necktie. The necktie retainer of the invention holds the necktie to a restricted range of travel, is not visible from the front and does not introduce distortion into the necktie.

DESCRIPTION OF THE DRAWINGS

FIG. 1 is a perspective schematic illustrating the portions of the necktie and the retention principle of the invention.

FIG. 2 is an illustration of the preferred embodiment of the invention.

FIG. 3 is a detail schematic of the attachment of the preferred embodiment to the necktie.

DESCRIPTION OF THE INVENTION

Figure 4:
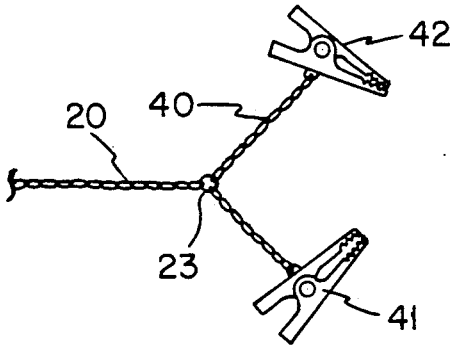
FIGS. 4–6 are illustrations of necktie attachment end devices.

Referring to FIG. 1, a perspective schematic view is shown of the parts of the necktie in position for wearing with the necktie retainer of the invention. The necktie 1 has a face portion 2 of a material usually chosen for appearance. The face material is folded at the edges 3 and 4 to abut longitudinally 5 the length of the necktie. The longitudinal abutment 5 is usually stitched together at various points 6 along the length. The portions 7 and 8 of the face material lie flat at the rear of the necktie. The portion 7 is shown raised to show a reinforcing member 9 used in some necktie constructions. The face material in some necktie constructions also has a lining member 10 stitched 11 at the edges. The smaller end 12 of the necktie is shown positioned under the larger end 13.

As further illustrated in FIG. 1, the necktie 1 when in position encircling the neck of the wearer has a portion 14 that goes around the neck of the wearer usually fitting under a collar 15 in most situations of use. The larger end 13 is tied around the smaller end 12 in a knot 16 that is positioned adjacent the neck of the wearer with the larger end 13 symmetrically compressed in folds 17 as it enters the knot 16.

Some of the parts illustrated, such as the reinforcing member 9 and the lining member 10, are, in some necktie constructions, replaced or eliminated by using a heavier or a different property material 2.

It will be apparent that the construction of a necktie is of parts that have interdependent functional and aesthetic properties and that in use, when the necktie is being worn, the parts must be free to move relative to each other. It is for this reason that retention must be accomplished without distortion of the relative position of the parts and without damaging the appearance of those parts when tied in a knot and involved in movement of the wearer.

In accordance with the invention, a retention principle for confining a necktie is provided wherein the necktie is attached to the garment of the wearer, usually a shirt, by a filamentary material tensor member that has two full swivel, flexure, or fully moveable points at the travel length of the retainer with mechanical attachment to the necktie being distributed between the rear folded over portions 7 and 8 of the face material. Returning to FIG. 1, the necktie 1 is retained by a filamentary material tensor member 20 of flexible material, such as light chain or thread, that is attached to the garment or shirt 21 of the wearer at an attachment point 22 having full flexure or swivel type properties. Where the tensor is of highly flexible filamentary material, the full flexure points are a property of the material. The tensor member 20 has a length, governed by the freedom of movement in wearing desired by the wearer, generally between two and three inches. At the region of attachment of the necktie there is a second point of full flexure or swiveling 23 beyond which mechanical attachment to the necktie is distributed between the left and right rear folded over portions 7 and 8.

Mechanical attachment may be contrasted with adhesive and perforation type attachments in that it is readily releasable, does not cover a broad area and does not damage the material of the necktie.

The distributed attachment is shown illustratively in FIG. 1 as a length of flexible material 24, centrally attached at point 23 and attached to portion 8 at, point 25 and attached to portion 7 at point 26. The attachment at points 25 and 26 may be by any means that doesn't distort the relative position of the materials, such as friction or perforation. The preferred attachment is attachment at point 23 to a label type cross member employed in many tie constructions that serves the combined functions of element 24 and points 25 and 26. The space between points 25 and 26 bounded by the larger end 13 and the element 24 is useable for confinement of the smaller end 12 shown shorter in FIG. 1 to clarify the illustration.

The necktie retainer principle of the invention provides many interdependent functional and aesthetic advantages not available heretofore in the art. With the principle of the invention the necktie is retained at the selected distance from the garment through attachment that distributes the forces in retention over both the portions 7 and 8 thereby gaining the advantage of having the parts of the necktie able to move with respect to each other and avoiding distortion in appearance. The principle of the invention is independent of and accommodates different garment or shirt constructions and different necktie constructions, as well as leaving the necktie free to have its resiliency restore the shape during periods of non-wearing and cleaning. The principle of the invention does not have parts visible from the front or require a central perforation of the material 2 and the reinforcing member 9. Central perforations, such as made by perforating post and friction retainer devices commonly known as a "tie tack" have the disadvantage that aesthetically once the perforation is made, it is always visible unless that type of device is used, the material 2 is damaged and frequently loose threads are visible and functionally the post of that type of device stops relative motion between the members 2 and 9. Another type of currently used necktie retention device is the tie bar which, while it does not require a perforation through the tie material, does however grip the parts and prevent relative movement leading to, among other things, bulging.

In FIGS. 2 and 3 there is shown the principles of the preferred embodiment of the tie retainer. In the preferred embodiment, advantage is taken of the fact that in the majority of necktie constructions at this point in time, there is a cross member that usually bears some manufacturer's identification that is stitched at each end to each of the rear folded portions of the material 2 so that attachment to the cross member provides the distributed attachment to the necktie essential for freedom from distortion.

Referring to FIG. 2, in a perspective schematic view, the preferred embodiment is shown attached to a shirt 30 at a buttonhole 31 and to a cross member 32 on the back of the necktie. The cross member 32 is stitched at locations 33 and 34 to portions 7 and 8, respectively, of the necktie. The tensor member 20 is attached at full flexure point 22 to an end attachment shown as a bar 35 which is positioned transversely in the buttonhole 31 and retained in position by the button 36. The tensor member 20 is further attached at full flexure point 23 to the cross member 32 on the necktie by a readily detachable member 35 which in the preferred embodiment is essentially C shaped and essentially encircles the cross member 35 but it is detachable through a smaller slot-like opening 37 which is less than the height of the cross member 35 in the plane parallel to the necktie. The slot-like opening 37 has a slot that is wider than the thickness of the cross member 35. The resulting structure distributes the attachment tension over both portions 7 and 8 equally.

Referring next to FIG. 3, in a detailed perspective schematic, the member 35, usually of metal, is generally shaped like a C with a long vertical dimension greater than the height of the cross member 32 and has an opening 37 about the thickness of the cross member 32. The member 35 provides mechanical attachment, is thus readily releasable and the height of the cross member 32 being greater than the opening 37 permits it to stay in place during wearing. The member 35 may be provided with a decorative surface, if desired.

Figure 5:
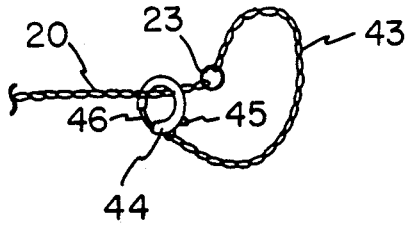
Figure 6:
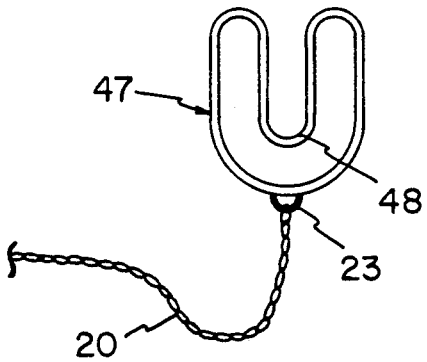

It will be apparent that a variety of mechanical attachment arrangements may be employed. In FIGS. 4, 5 and 6, illustrative arrangements are shown for distributed force necktie attachment at point 23. Referring to FIG. 4, an end is provided for a necktie where a cross member is not available o not desirable. In FIG. 4, a length of flexible material 40, such as light chain, is attached at point 23 at its midpoint and at each end thereof is provided an attachment end 41 and 42 of the friction type, such as a small alligator chip, which, in use, would grip the portions 7 and 8 of the necktie and member 40 operates to confine movement of the smaller end 12 during wearing.

Referring next to FIG. 5, the mechanical attachment is a length 43 of the material of the tensor member 20 extended beyond the point 23 which is looped around the cross member 32, not shown, and secured to itself with a conventional clasp 44 of the type in which a toggle 45 can open a spring loaded pin 46.

Referring next to FIG. 6, a mechanical attachment member 47 is fastened at point 23 and has a paper clip type portion 48 that extends behind and grips the cross member 32, not shown.

Figure 7:
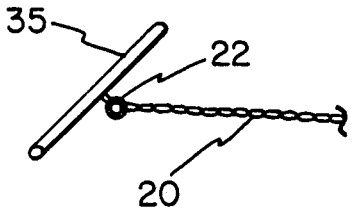
FIGS. 7–9 are illustrations of attachment ends at the garment.
Figure 8:
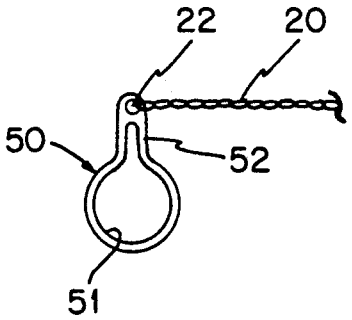
Figure 9:
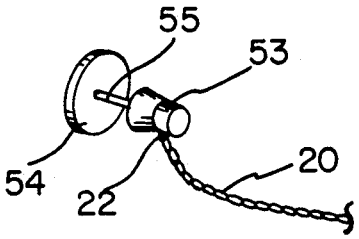

There are different types of upper garments and shown in FIGS. 7-9 are illustrative attachment members. In many situations, the wearer would have a conventional shirt with buttons and corresponding buttonholes and in FIG. 7 a member 35 is attached to the tensor member 20 at point 22. The member 20 is positioned, as illustrated in FIG. 2, crosswise in the buttonhole 31 above or below the button 36. Referring to FIG. 8, another type of button attachment is illustrated in which a member 50 is attached at point 22 to the tensor 20 and the button attachment member 50 has an opening 51 that slips over the button, not shown, and has a smaller portion 52 that generally frictionally grips the button retaining threads, also not shown. There are some upper garments that do not have buttons or buttonholes and for these types of garments the "tie tack" type of friction post structure as shown in FIG. 9 may be employed. In FIG. 9, the attachment has a friction holder member 53 attached to the tensor member 20 at point 22, with the friction holder member 53 positioned on a tack type post member 54 that extends from inside the garment with the post 55 extending through the material and engaging the friction holder member 53.

What has been described is a necktie retaining principle that confines movement of the necktie while distributing the forces and not interfering with relative movement of the necktie parts that can cause distortion in appearance.

Having thus described my invention, what I claim as new and desire to secure by Letters Patent is:

1. A necktie retainer in combination with a necktie and the garment of the wearer, said necktie when being worn having a large end portion with front and rear sides that lies essentially flat against said garment, said large end portion having a cross member positioned in transverse relationship to the long dimension and on said rear side thereof, said cross member having length, height and thickness dimensions and further having the portions thereof at the ends of said length dimension attached to said large end portion, comprising in combination;

a tensor member having a movement establishing length between first and second ends, means retaining said first end of said tensor member to the garment of the wearer, a detachable member attached to said second end of said tensor member, said detachable member having an essentially "C" shape, the opening of said "C" shape being a transverse slot of the order of said thickness dimension of said cross member, and the top to bottom internal dimension of said "C" shape being of the order of said height dimension of said cross member such that said detachable member grips said cross member.

2. The necktie retainer of claim 1 wherein said detachable member is of metal.

3. The necktie retainer of claim 2 wherein said tensor member is a light chain.

4. The necktie retainer of claim 1 wherein said means retaining said tensor member to said garment is a member taken from the group of buttonhole attachments, button attachments and perforating post and friction retainer devices.

* * * * *